US006298625B1

(12) United States Patent
Sweet

(10) Patent No.: US 6,298,625 B1
(45) Date of Patent: Oct. 9, 2001

(54) ROOF COVERING AND METHOD OF INSTALLATION

(76) Inventor: Vernon L. Sweet, 6363 Douglas Rd., Lambertville, MI (US) 48144

( * ) Notice: Subject to any disclaimer, the term of this patent is extended or adjusted under 35 U.S.C. 154(b) by 0 days.

(21) Appl. No.: 09/444,073

(22) Filed: Nov. 22, 1999

Related U.S. Application Data

(60) Provisional application No. 60/109,681, filed on Nov. 24, 1998.

(51) Int. Cl.[7] ..... E04D 1/00

(52) U.S. Cl. ..... 52/519; 52/409; 52/536; 52/520; 52/539; 52/542

(58) Field of Search ..... 52/409, 536, 520, 52/539, 542, 543, 519, 522, 529, 531

(56) References Cited

U.S. PATENT DOCUMENTS

| | | | | |
|---|---|---|---|---|
| 2,219,450 | * | 10/1940 | Koenig | 52/520 |
| 4,102,106 | * | 7/1978 | Golder et al. | 52/533 |
| 4,292,781 | * | 10/1981 | Chalmers et al. | 52/547 |
| 4,450,665 | * | 5/1984 | Katz | 52/522 |
| 4,854,102 | * | 8/1989 | Feil et al. | 52/535 |
| 4,930,287 | * | 6/1990 | Volk et al. | 52/748 |
| 4,987,716 | * | 1/1991 | Boyd | 52/520 |
| 5,224,318 | * | 7/1993 | Kemerer | 52/521 |
| 5,613,337 | | 3/1997 | Plath et al. . | |
| 5,671,577 | * | 9/1997 | Todd | 52/519 |
| 5,768,844 | * | 6/1998 | Grace, Sr. et al. | 52/529 |
| 5,832,686 | | 11/1998 | Plath et al. . | |
| 5,946,876 | * | 9/1999 | Grace, Sr. et al. | 52/520 |
| 5,956,913 | * | 9/1999 | Nicholson | 52/520 |
| 6,050,041 | * | 4/2000 | Mowery et al. | 52/520 |

OTHER PUBLICATIONS

Zappone Aluminum Shingles Specification Sheet, undated, 1 page.

"Wright–Foundation Features Innovative Cooper Shingles", undated, 2 pages.

Zappone Copper Shingle and Accessory Details, undated, 2 pages.

* cited by examiner

*Primary Examiner*—Beth A. Stephan
*Assistant Examiner*—Dennis L. Dorsey
(74) *Attorney, Agent, or Firm*—MacMillan, Sobanski & Todd, LLC

(57) ABSTRACT

A roof covering includes an upper portion, a lower portion, and a retainer. The upper portion includes a nailing strip, a water stop, a lock, and a lock indicator. After a first strip of the roof covering is installed on a roof, a second strip of the roof covering is interlocked with and secured to the first strip. A retainer of the second strip is received in the lock of the first strip to secure the strips together. Successive strips of roof coverings are added to a roof until a desired area is covered.

18 Claims, 3 Drawing Sheets

ROOF COVERING AND METHOD OF INSTALLATION

CROSS REFERENCE TO RELATED APPLICATION

This claims the benefit of United States provisional patent application identified as Application No. 60/109,681 filed Nov. 24, 1998.

BACKGROUND OF THE INVENTION

This invention relates in general to roofs for buildings and other structures, and in particular is concerned with a durable roof covering. Furthermore, this invention is concerned with a method of installing the disclosed durable roof covering.

Various materials have been used to cover roofs of structures. Examples of such materials include shingles formed from asphalt and metallic materials such as aluminum and copper. The shingles are formed in a convenient size having a width and length. To cover a roof, a patchwork of overlapping shingles is installed.

SUMMARY OF THE INVENTION

This invention includes a durable roof covering for roofs of buildings and other structures. The durable roof covering can be formed from bendable material such as aluminum or steel. The roof covering can be pressed or otherwise formed as desired and cut to a length that matches the application, such as the width of a roof. Layers of the covering can be secured to cover and protect a roof and structure.

This invention includes a roof covering having an upper portion, a lower portion, and a retainer. The upper portion includes a nailing strip, a water stop, a lock, and a lock indicator. After a first strip of the roof covering is installed on a roof, a second strip of the roof covering is interlocked with and secured to the first strip. A retainer of the second strip is received in the lock of the first strip to secure the strips together. Successive strips of roof coverings are added to a roof until a desired area is covered.

Various objects and advantages of this invention will become apparent to those skilled in the art from the following detailed description of the preferred embodiments, when read in light of the accompanying drawings.

DETAILED DESCRIPTION

Figure 1:
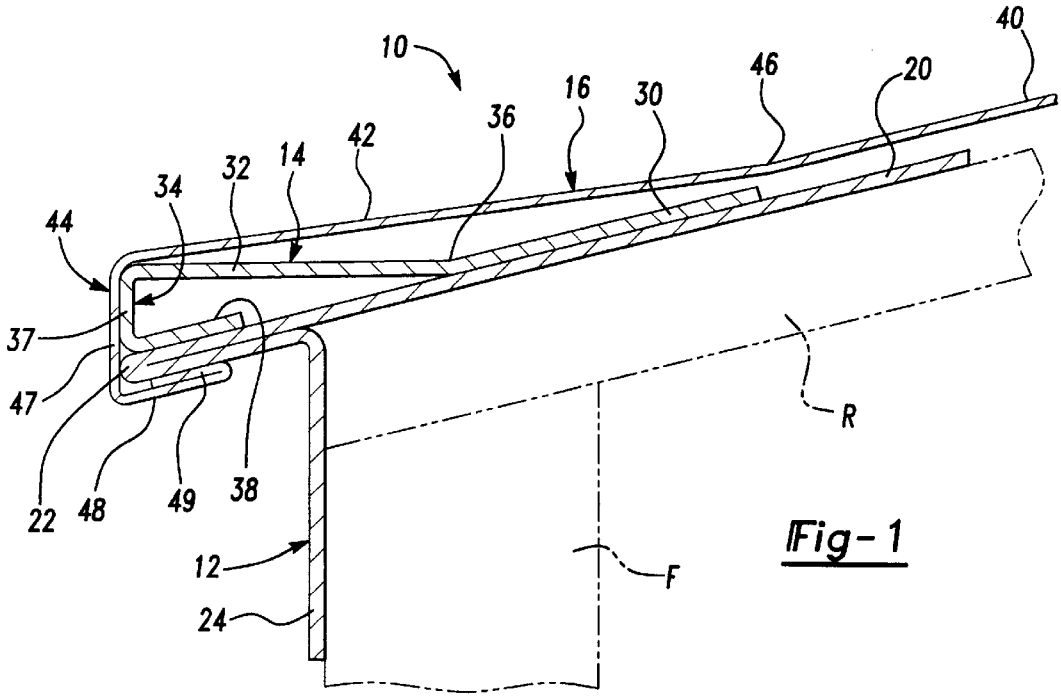
FIG. 1 is an enlarged sectional view of a portion of a durable roof covering assembly according to this invention mounted to a roof of a structure.

A roof covering assembly according to this invention is indicated generally at 10 in FIG. 1. The assembly 10 is mounted on an upper surface of a roof R of a structure to protect the roof and structure from elements of the weather. The assembly 10 includes a drip edge 12, a starter strip 14, and a durable roof covering 16.

The drip edge 12 is preferably formed from a bendable material such as aluminum or (light) steel and includes a roof portion 20, a folded portion 22, and a downwardly projecting portion 24. The drip edge 12 is secured to the roof R and/or a fascia board F so that the downwardly projecting portion 24 is preferably against the fascia board F.

The starter strip 14 is preferably formed from a bendable material such as aluminum or steel and includes an upper portion 30, an angled portion 32, and a spacer 34. The upper portion 30 is preferably secured to the roof portion 20 of the drip edge 12. A bend line 36 is formed between the upper portion 30 and the angled portion 32. The angled portion 32 is angled upwardly from a plane running through the upper portion 30. The spacer 34 is formed by bending or curling a terminating portion of the starter strip 14. The spacer 34 can include downwardly projecting wall 37 and a rearwardly projecting portion 38.

A portion of the roof covering 16 is shown in FIG. 1. The roof covering 16 is preferably formed from a bendable material such as aluminum or steel and includes a planar upper portion 40, a lower portion 42, and a retainer 44. Preferably, the upper portion 40, the lower portion 42, and the retainer 44 are formed as an integral member. The upper portion 40 is preferably secured to the roof R. A bend line 46 may be formed between the upper portion 40 and the lower portion 42. The lower portion 42 is preferably either angled upwardly from a plane running through the upper portion 40 (as illustrated) or formed with a concave surface between the upper portion 40 and the retainer 44 (not illustrated). The retainer 44 is formed by bending or curling a terminating portion of the roof covering 16. The retainer 44 can include a downwardly projecting wall 47 and a rearwardly projecting portion 48. A folded portion 49 can be provided to strengthen the retainer 44. The rearwardly projecting portion 48 is spaced from the lower portion 42 so that the spacer 34 of the starter strip 14 and the folded portion 22 of the drip edge 12 are received in the retainer 44. The retainer 44 secures the terminating portion of the roof covering 16 to the building via the secured drip edge 12. The retainer 44 can be clamped or bent so that the folded portion 49 rests snugly against the folded portion 22 of the drip edge 12.

Figure 2:
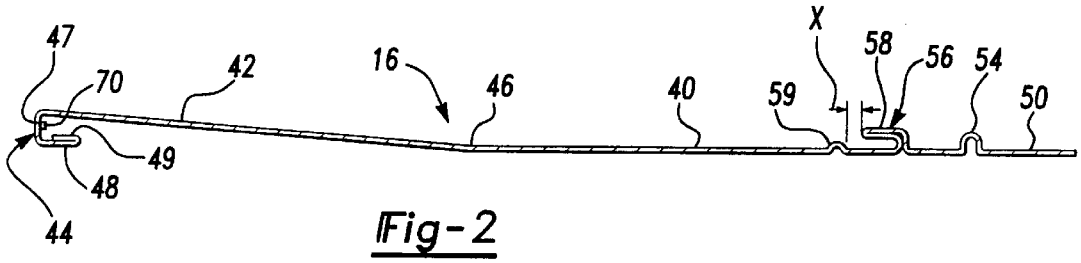
FIG. 2 is a side view of a complete roof covering removed from the balance of the roof covering assembly of FIG. 1 for clarity of illustration.
Figure 3:
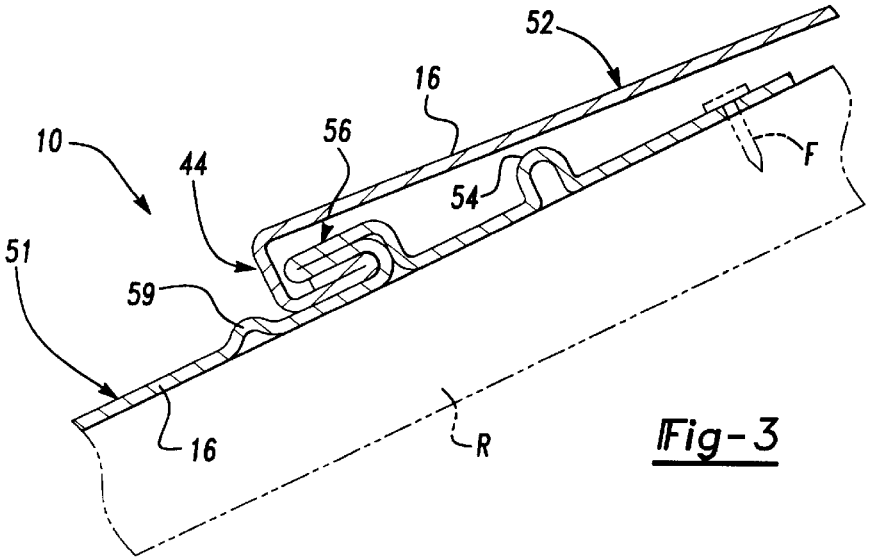
FIG. 3 is an enlarged side view of a second strip of roof covering secured to a first strip of roof covering according to this invention.

A side view of the complete roof covering 16 removed from the balance of the assembly 10 is illustrated in FIG. 2. The upper portion 40 terminates in a planar nailing strip 50. The nailing strip 50 can include a plurality of spaced-apart slots 52, only one of which is illustrated in FIG. 3. Nails or other suitable fasteners (not illustrated) are received in the slots 52 to secure the covering 16 to the roof R. A water stop 54 is formed parallel the nailing strip 50. Preferably, curling or bending the material of the covering 16 in a continuous pattern forms the water stop 54. A lock 56 is formed parallel the water stop 54. Preferably, curling and bending the material of the covering 16 in a continuous pattern forms the lock 56. The lock 56 preferably includes a forwardly extending leg 58 spaced above the upper portion 40. A lock indicator 59 is formed parallel to the lock 56 opposite the water stop 54. Preferably, curling and bending the material of the covering 16 in a continuous pattern forms the lock indicator 59. The lock indicator 59 is spaced a predetermined distance X from the lock 56. The distance X is preferably greater than a thickness of the wall 47 of the retainer 44.

When the roof covering assembly 10 is installed, a first strip S1 of covering 16 is cut to a predetermined length to satisfy the need of the roof R. As illustrated in FIG. 3, the first strip S1 is secured to the roof R by fasteners F. A second strip S2 of covering 16 is cut to a predetermined length to satisfy the need of the roof R. The retainer 44 of the second strip S2 is received in the lock 56 of the first strip S1. The retainer 44 is forced into the lock 56 until the lock indicator 59 is visible. Thus, the lock indicator 59 provides a visible sign that the second strip S2 is properly fitted or interlocked to the first strip S1. This process of installation is continued by successive strips of coverings 16 until the desired portion of the roof R is covered. In other applications, a first strip of covering 16 can be installed at a ridge of a roof R and a second strip of covering 16 can be installed below the first strip. This process of installation is continued by successive strips of coverings 16 until the desired portion of the roof R is covered.

The water stop 54 prevents a buildup of water around the interlocked portions of the first and second strips S1 and S2. Water rolling down the nailing strip 50 encounters the water stop 54 and is prevented from freely traveling to the lock 56.

Figure 4:
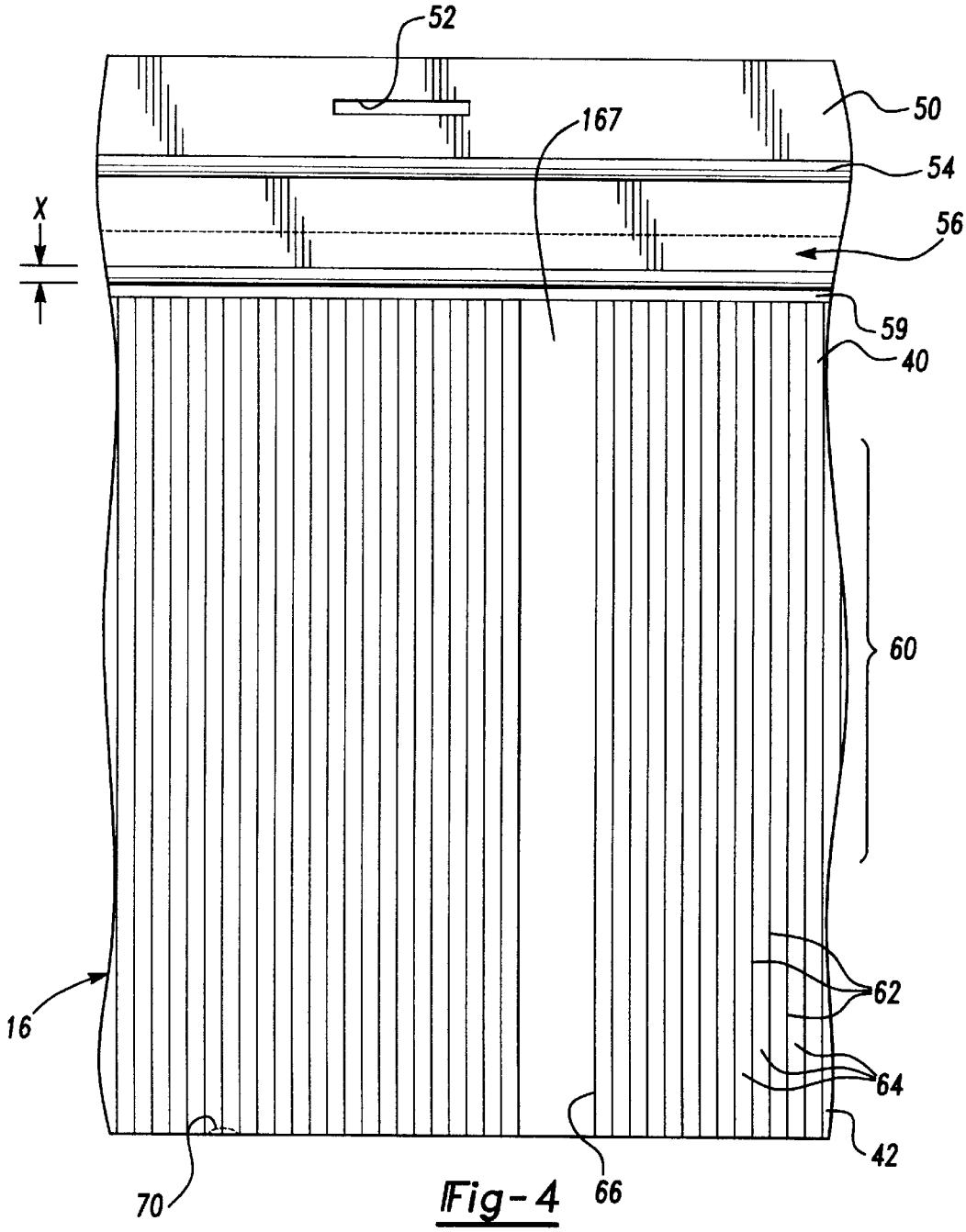
FIG. 4 is a top plan view of a portion of the roof covering of FIG. 2.
Figure 5:
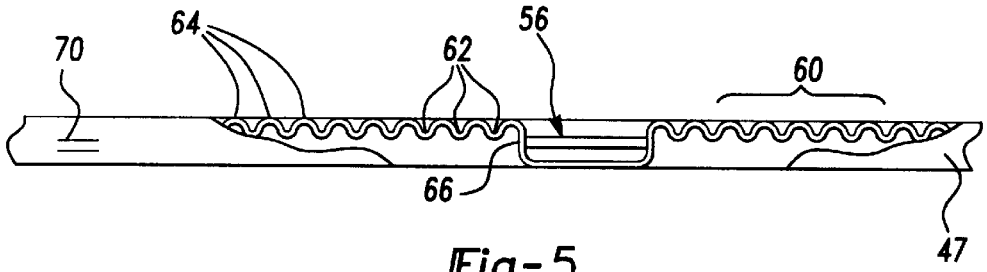
FIG. 5 is a bottom edge view of the roof covering of FIGS. 2 and 4 with a portion removed to illustrate a pattern formed in an upper surface.

As illustrated in FIGS. 4 and 5, a pattern 60 is preferably formed in the upper surfaces of the upper portion 40 and the angled portion 42. The pattern 60 can include a series of parallel line indentations 62 pressed or otherwise formed in the upper surfaces. The line indentations 62 have ridges 64 between them. The pattern 60 directs water downwardly from the upper portion 40 to the angled portion 42 to the retainer 44 where it falls away. The pattern 60 resists water travel, such as wind blown rain, that traverses the indentations 62. The pattern 60 also provides a pleasing appearance.

If desired, a series of channels 66 can also be provided in the pattern 60. The channels 66 can be formed by bending or pressing the material of the upper portion 40 and the angled portion 42. The channels 66 direct water downwardly and provide a pleasing appearance. In other embodiments, flats (not illustrated) can be included with or substituted for the channels 66 in the pattern 60.

If desired, weep openings 70, illustrated in FIGS. 2, 4, and 5, can be formed in the downwardly projecting wall 47 of the retainer 44. The weep openings 70 can be formed by puncturing a portion of the material of the wall 47 so that water may weep from beneath the covering 16.

Figure 6:
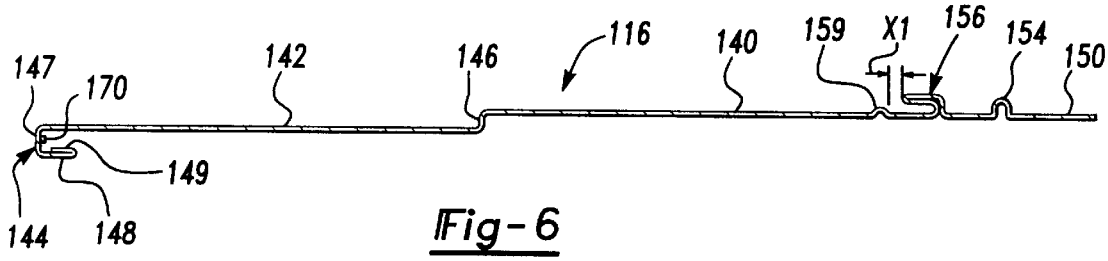
FIG. 6 is a side view of a second embodiment of a roof covering according to this invention.
Figure 7:
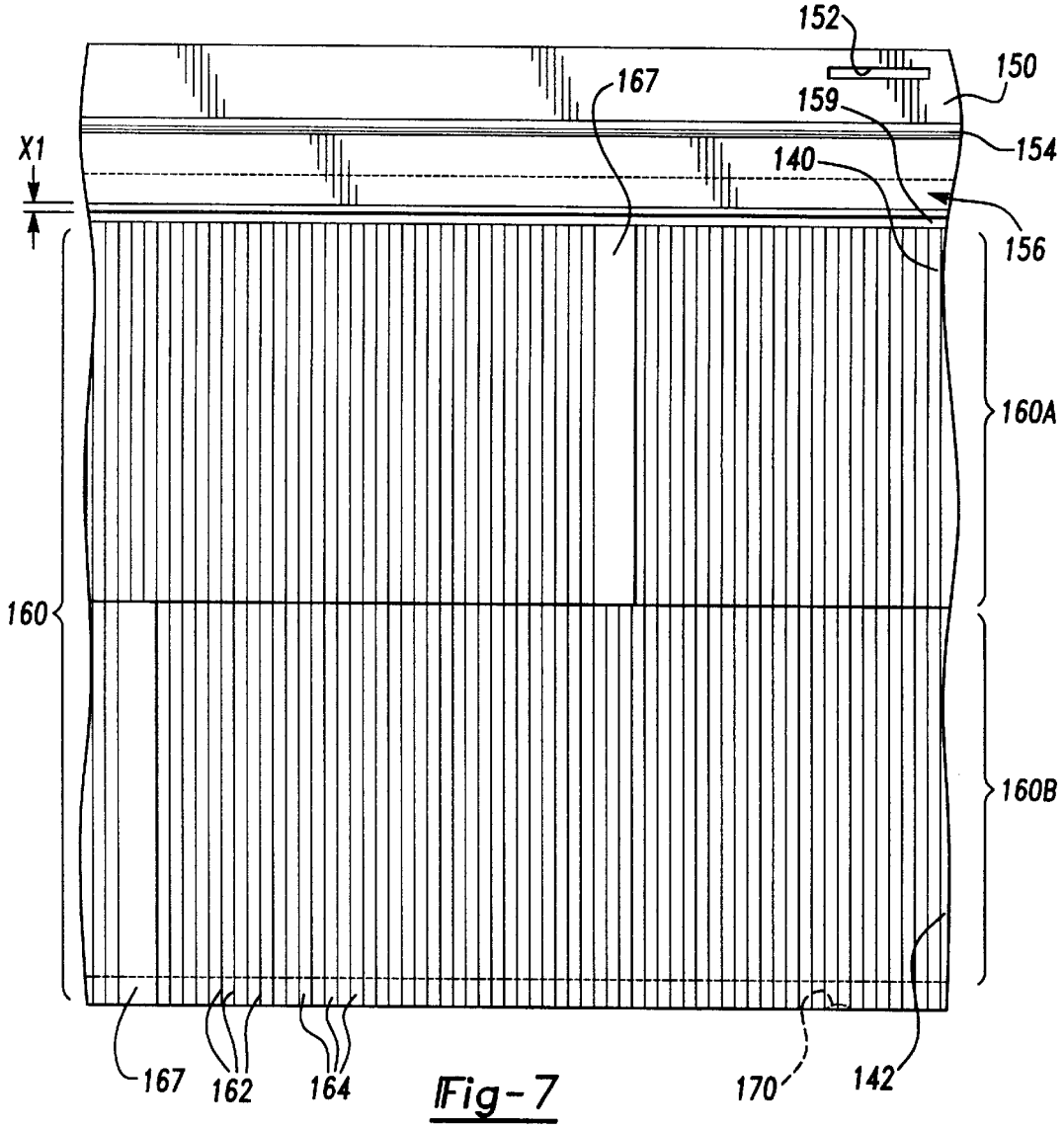
FIG. 7 is a top plan view of a portion of the roof covering of FIG. 6.
Figure 8:
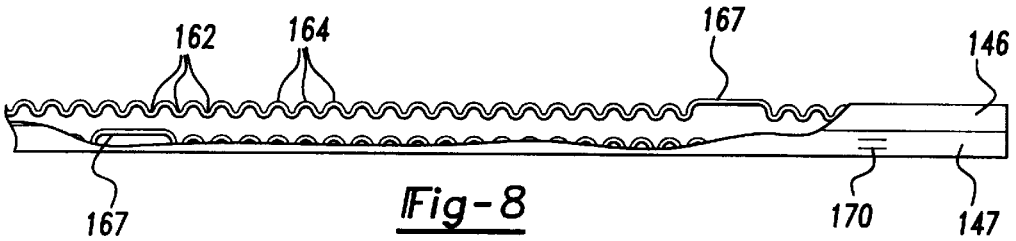
FIG. 8 is a bottom edge view of the roof covering of FIGS. 6 and 7 with a portion removed to illustrate a pattern formed in upper surfaces.

A second embodiment of a durable roof covering 116 is illustrated in FIGS. 6, 7, and 8. The roof covering 116 can be substituted for roof covering 16 and used in roof covering assembly 10 in a like manner.

The roof covering 116 is preferably formed from a bendable material such as aluminum or steel and includes a planar upper portion 140, a lower portion 142, and a retainer 144. The upper portion 140 is preferably secured to the roof R. A downwardly projecting wall 146 is formed between the upper portion 140 and the lower portion 142. The lower portion 142 is offset from the upper portion 140 by the length of the wall 146. The retainer 144 is formed by bending or curling a terminating portion of the roof covering 116. The retainer 144 can include a downwardly projecting wall 147 and a rearwardly projecting portion 148. A folded portion 149 can be provided to strengthen the retainer 144. The rearwardly projecting portion 148 is spaced from the lower portion 142 so that the spacer 34 of the starter strip 14 and the folded portion 22 of the drip edge 12 are received in the retainer 144. The retainer 144 secures the terminating portion of the roof covering 116 to the building via the secured drip edge 12.

The upper portion 140 terminates in a planar nailing strip 150. The nailing strip 150 includes a plurality of spaced-apart slots 152, only one of which is illustrated in FIG. 7. Nails or other suitable fasteners (not illustrated) are received in the slots 152 to secure the covering 116 to the roof R. A water stop 154 is formed adjacent the nailing strip 150. Preferably, the water stop 154 is formed by curling or bending the material of the covering 116. A lock 156 is formed adjacent the water stop 154. Preferably, the lock 156 is formed by curling and bending the material of the covering 116. The lock 156 preferably includes a forwardly extending leg 158 spaced above the upper portion 140. A lock indicator 159 is formed parallel to the lock 156 opposite the water stop 154. Preferably, curling and bending the material of the covering 116 in a continuous pattern forms the lock indicator 159. A predetermined distance X1 is provided between the lock 156 and the lock indicator 159. The distance X1 is preferably greater that a thickness of the wall 147 of the retainer 144.

When the covering 116 is installed on a roof R, a first strip having a predetermined length is cut to satisfy the need of the roof R. The first strip is secured to the roof R. A second strip of covering 116 is then cut and installed. The retainer 144 of the second strip is received in the lock 156 of the first strip. The retainer 144 is forced into the lock 156 until the lock indicator 159 is visible. Thus, the lock indicator 159 provides a visible sign that the second strip is properly fitted to the first strip. The process of installation is continued by successive strips of coverings 116 until the desired portion of the roof R is covered. In other applications, a first strip of covering 116 can be installed at a ridge of a roof R and a second strip of covering 116 can be installed below the first strip. This process of installation is continued by successive strips of coverings 116 until the desired portion of the roof R is covered.

As illustrated in FIGS. 7 and 8, a pattern 160 of indentations is preferably formed in the upper surfaces of the upper portion 140 and the lower portion 142. The pattern 160 can include a series of parallel line indentations 162 pressed or otherwise formed in the upper surfaces. The line indentations 162 have ridges 164 between them. This pattern 160 directs water downwardly from the upper portion 140 to the lower portion 142 to the retainer 144 where it falls away. The pattern 160 also provides a pleasing appearance.

If desired, a series of flats 167 can also be provided in the pattern 160. The flats 167 can be formed by skipping the pressing of the material of a portion the upper portion 140 and the lower portion 142. The flats 167 direct water downwardly and provide a pleasing appearance. In other embodiments, channels (not illustrated) like channels 66 can be included with or substituted for the flats 167 in the pattern 160.

Preferably, the pattern 160 is divided into a first section 160A and a second section 160B. The first section 160A can correspond to the area of the pattern 160 of the upper portion 140. The second section 160B can correspond to the area of the lower portion 142. If desired, the flats 167 of section 160A can be offset so that they do not align with flats 167 of section 160B as illustrated. The line indentations 162 and ridges 164 of sections 160A and 160B can be aligned as illustrated.

If desired, weep openings 170, illustrated in FIGS. 6, 7, and 8, can be formed in the downwardly projecting wall 147 of the retainer 144. The weep openings 170 can be formed by piercing or puncturing a portion of the material of the wall 147 so that water may weep from beneath the covering 116.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A roof covering comprising;

a covering, formed from a bendable material, having integrally formed portions including an upper portion, a lower portion, and a retainer;

wherein the upper portion includes a lock for receiving a like retainer of a like covering, a lock indicator downstream from the lock, and a water stop upstream of the lock; and whereby the lock indicator provides a visable indication when the like retainer of the like covering is properly inserted in the lock; wherein the lock indicator extends outwardly from a surface of the upper portion.

2. The roof covering specified in claim 1 wherein the lock and lock indicator are parallel to each other.

3. The roof covering specified in claim 1 wherein the upper portion also includes a nailing strip.

4. The roof covering specified in claim 3 wherein the nailing strip is parallel to the lock.

5. The roof covering specified in claim 1 wherein the lock indicator is spaced a predetermined distance from the lock.

6. The roof covering specified in claim 1 wherein the water stop is parallel to the lock.

7. The roof covering specified in claim 1 wherein a pattern of indentations is formed in at least the upper portion.

8. The roof covering specified in claim 7 wherein the pattern is also formed in the lower portion.

9. The roof covering specified in claim 8 wherein the pattern of the upper portion is offset from the pattern of the lower portion.

10. The roof covering specified in claim 7 wherein the indentations resist travel of water traversing the indentations.

11. The roof covering specified in claim 1 wherein the retainer includes a downwardly projecting wall and a rearwardly projecting portion.

12. A roof covering assembly comprising:

a first covering of a predetermined length having a lock and a lock indicator; and a second covering of a predetermined length having a retainer including a downwardly projecting wall;

wherein the lock indicator is spaced a predetermined distance from the lock greater than a thickness of the downwardly projecting wall, the retainer of the second covering is forced into the lock of the first covering until the lock indicator provides a visible indication to secure the second covering to the first covering and the downwardly projecting wall is between the lock and the lock indicator; wherein the lock indicator extends outwardly from a surface of the first covering.

13. The roof covering assembly specified in claim 12 where in the first covering includes a water stop upstream of the lock.

14. The roof covering assembly specified in claim 12 wherein the first covering includes a pattern of indentations to direct water downwardly.

15. The roof covering assembly specified in claim 12 wherein the water stop is provided between the lock and a nailing strip.

16. The roof covering assembly specified in claim 15 wherein slots are provided in the nailing strip.

17. A method of installing a roof covering comprising the steps of:

providing a first covering of a predetermined length having a retainer with a wall, a lock, and a lock indicator;

providing a second covering of a predetermined length having a retainer;

securing the first covering to a roof; and inserting the retainer of the second covering into the lock of the first covering until the lock indicator provides a visible indication to secure the second covering to the first covering and the wall of the retainer is positioned between the lock and the lock indicator; wherein the lock indicator extends outwardly from a surface of the first covering.

18. The method of installing a roof covering specified in claim 17 wherein the second covering include a lock and a lock indicator, and including the steps of:

providing a third covering of a predetermined length having a retainer; and inserting the retainer of the third covering into the lock of the second covering until the lock indicator of the second covering is visible to secure the third covering to the second covering.

* * * * *